US010328557B2

(12) United States Patent
Arbuckle et al.

(10) Patent No.: US 10,328,557 B2
(45) Date of Patent: Jun. 25, 2019

(54) WALL PUNCH ASSEMBLY AND METHODS OF USE

(71) Applicants: William Arbuckle, Clovis, CA (US); Michael Van Horst, Fresno, CA (US)

(72) Inventors: William Arbuckle, Clovis, CA (US); Michael Van Horst, Fresno, CA (US)

( * ) Notice: Subject to any disclaimer, the term of this patent is extended or adjusted under 35 U.S.C. 154(b) by 355 days.

(21) Appl. No.: 15/390,312

(22) Filed: Dec. 23, 2016

(65) Prior Publication Data

US 2017/0259418 A1 Sep. 14, 2017

Related U.S. Application Data

(63) Continuation-in-part of application No. 29/584,846, filed on Nov. 17, 2016, now Pat. No. Des. 819,465.

(60) Provisional application No. 62/308,092, filed on Mar. 14, 2016.

(51) Int. Cl.

| | |
|---|---|
| ***A47G 1/16*** | (2006.01) |
| ***A47G 1/20*** | (2006.01) |
| ***B25C 1/02*** | (2006.01) |
| ***B25C 3/00*** | (2006.01) |
| ***B25H 7/04*** | (2006.01) |

(52) U.S. Cl.

CPC ..... *B25C 3/006* (2013.01); *A47G 1/16* (2013.01); *A47G 1/205* (2013.01); *B25C 1/02* (2013.01); *B25H 7/04* (2013.01)

(58) Field of Classification Search

CPC ..... A47G 1/205; B25C 1/02; B25C 3/006; B25C 3/008; B25C 7/00

USPC ..... 33/613, 374, 451, 666

See application file for complete search history.

(56) References Cited

U.S. PATENT DOCUMENTS

| | | | | |
|---|---|---|---|---|
| 5,069,411 A * | 12/1991 | Murphy | ..... | A47G 1/164 248/287.1 |
| 5,103,573 A | 4/1992 | Ehling et al. | | |
| 5,103,574 A * | 4/1992 | Levy | ..... | A47G 1/205 33/613 |

(Continued)

FOREIGN PATENT DOCUMENTS

| | | |
|---|---|---|
| CN | 2086651 | 10/1991 |
| DE | 19501383 C3 | 9/1998 |

OTHER PUBLICATIONS

Hang It Perfect Easy Frame Hanging Tool (2012) http://www.amazon.com/Perfect-Frame-Hanging-Black-HIP36/dp/B005Z2700Q.

(Continued)

*Primary Examiner* — Jason L Vaughan
(74) *Attorney, Agent, or Firm* — Mark D. Miller

(57) ABSTRACT

The present invention includes devices and methods that assist in hanging pictures or other things in a desired position on a wall or other similar surface where it is desired to insert two or more mounting nails. Embodiments of the invention include a pair of punch assemblies for inserting the nails provided on a pair of parallel stabilizing bars, although other embodiments may include more than two punch assemblies. Preferred embodiments also include a measuring strip (ruler) between the punch assemblies, and a slidable level and/or a laser. The unique nail insertion mechanism includes a sleeve for receiving a finishing nail, a magnet for holding the nail in place, and a coil spring for maintaining the handle in striking position. After positioning the device on a wall, applying force to each handle collapses the spring and causes a nail to be driven into the wall.

16 Claims, 7 Drawing Sheets

(56) References Cited

U.S. PATENT DOCUMENTS

| | | | | |
|---|---|---|---|---|
| 5,520,318 | A * | 5/1996 | Sloop | A47G 1/205 227/147 |
| 6,029,362 | A | 2/2000 | Miodragovic | |
| 6,443,348 | B2 | 9/2002 | Lamb | |
| 6,971,184 | B2 | 12/2005 | Prevost | |
| 7,155,840 | B1 | 1/2007 | Carbonaro | |
| 7,210,243 | B2 | 5/2007 | Schmidt et al. | |
| 8,061,054 | B2 | 11/2011 | Rabin | |
| 8,286,363 | B1 | 10/2012 | Martinez | |
| D679,613 | S | 4/2013 | Propp et al. | |
| 8,739,423 | B1 | 6/2014 | Cortum et al. | |
| D737,109 | S | 8/2015 | Gargallo et al. | |
| D803,076 | S | 11/2017 | Ulloa et al. | |
| 2002/0095812 | A1 | 7/2002 | Newman | |
| 2005/0087668 | A1 | 4/2005 | Cismoski et al. | |
| 2006/0134375 | A1 * | 6/2006 | Peterson | A47G 1/20 428/100 |
| 2006/0174504 | A1 * | 8/2006 | Szumer | B25H 7/02 33/613 |
| 2013/0333233 | A1 | 12/2013 | Esposito | |
| 2017/0303709 | A1 | 10/2017 | Ulloa et al. | |

OTHER PUBLICATIONS

Instahang (2012) https://www.instahang.com/.
Hang-O-Matic (2016) http://www.eagleamerica.com/product/418-1010/measuring_and_layout.
Hang It Perfect (2016) https://hangitperfect.com/HIP%20Frame%20Grouping%20Instructions%20Vertical%20and%20Horizontal.pdf.
InstaHang (2016) http://www.directionsforme.org/item/870700.
InstaHang (2016) http://thumbs4.ebaystatic.com/d/I225/m/mEXI5XHond2VuDwpIrpaCjQ.jpg.
Moonshine Framing (2016) https://www.pinterest.com/pin/AU5dQZs-Eq2kmlkSXPPI2MC7E-rG35LisnrHIR2K3fwho_Sql0N_Bw/.

* cited by examiner

WALL PUNCH ASSEMBLY AND METHODS OF USE

This application claims the benefit of U.S. Provisional patent application No. 62/308,092 filed on Mar. 14, 2016, and U.S. Design patent application No. 29/584,846 filed on Nov. 17, 2016, both of which are incorporated herein in their entirety by this reference.

WALL PUNCH ASSEMBLY AND METHODS OF USE

The present invention relates to methods and apparatus that assist in hanging pictures or other things in a desired, level position on a wall or similar surface, and more particularly to a double nail insertion tool with sliding leveling assembly and sliding punch assembly, and methods use thereof.

BACKGROUND OF THE INVENTION

Generally, it is a difficult task for someone to position a picture, or other similar object, in a level placement on a wall when the object requires two or more mounting points. Holding the item, such as a picture, marking the spots to place the mounting studs, and inserting the studs often present problems, especially if performed by a single person. The task may require numerous attempts before a level placement is achieved, resulting in wasted time and multiple holes in the wall or other surface.

It would therefore be beneficial for homeowners, artists, home decorators, and others, to have a device that will aid them in quickly, safely and efficiently mounting objects in desired level manner without the need for another person to assist, nor the need for additional tools such as a tape measure, level, hammer, tape, etc.

SUMMARY OF THE INVENTION

The present invention makes it possible for one person to quickly, safely and efficiently hang and position objects on a wall or other similar surface requiring two or more support points by providing apparatus and methods for the insertion of two or more mounting studs (e.g., nails) into a wall or other similar surface, and placing the studs such that are level with each other. Embodiments of a basic unit of the present invention include at least two punch assemblies for inserting the mounting studs, the assemblies being movably provided on a pair of parallel stabilizing bars. It is to be appreciated that embodiments of the invention may include more than two punch assemblies. Each punch assembly resembles a stapler, and includes a large handle that is pivotally attached at one end to a base. The base of the pivoting end of each punch assembly is movably mounted to one of the stabilizing bars, and the another section of the base, which includes a unique nail insertion mechanism, is mounted to the other parallel stabilizing bar.

In preferred embodiments, one of the punch assemblies may be fixed to the proximal ends of the parallel stabilizing bars, with the distal ends of the bars attached to a hand grip and/or handle, thereby forming a frame. In these embodiments, the other punch assembly is being free to slide along the stabilizing bars to allow the user to choose an appropriate spacing between the mounting studs to be inserted. Other embodiments of the device may include a third slidably mounted punch assembly deployed between the first two, if desired.

A key element of each punch assembly is the large, pivotally attached handle. Embodiments of the handle allow for driving the studs into the wall by pivoting about the stabilizing bar and providing the necessary impact for inserting the stud when a force is applied to the free end of the punch assembly handle. A secondary benefit is that all nails or studs may be placed with the head protruding a desired (preferably identical) distance out from the wall, and at a desired angle for precision positioning.

Embodiments of the nail insertion mechanism, which is located opposite the pivoting end of punch assembly, include a sleeve for receiving a stud or nail, a magnet for holding the nail or stud in place, and a coil spring for maintaining the handle in striking position. Applying force to the punch assembly handle collapses the spring and drives a nail or stud into a wall. A key benefit is that the system is designed to insert a nail to an exact distance of the nail head to the wall and at a desired angle.

Embodiments of the dual nail insertion device of the present invention may include a strip with measuring indicia (e.g., a ruler) between the punch assemblies to allow for precise and repeatable placement of the nails. Such a measuring strip may be placed parallel to either of the stabilizing bars, preferably near or incorporated into the stabilizing bar adjacent to the nail insertion mechanism of each punch.

In embodiments of the invention, a sliding bubble level may be attached to the ruler for the purpose of providing properly aligned (i.e., level) nails. For more precise leveling, and to allow for the use of reference(s) to other objects on or near the wall, a laser pen may be attached to the frame, such as, for example, at one or both ends of the tool.

In embodiments of the invention, the pivoting handle of each punch may have openings to allow the user to view the measurements on the ruler to confirm placement of a nail before it is inserted. These openings may include magnified lenses to assist in such viewing.

In embodiments of the invention, an extension may be provided on one or more of the handles of the punch assemblies to provide additional torque when inserting a nail into a wall. In embodiments of the invention, the hand grip at one end of the frame may extend out from (i.e., perpendicular to) the wall or other surface to facilitate easy movement and adjustment of the device.

BRIEF DESCRIPTION OF THE DRAWINGS

The various advantages of this invention may be more fully appreciated when considered in conjunction with accompanying drawings.

DETAILED DESCRIPTION

Figure 1:
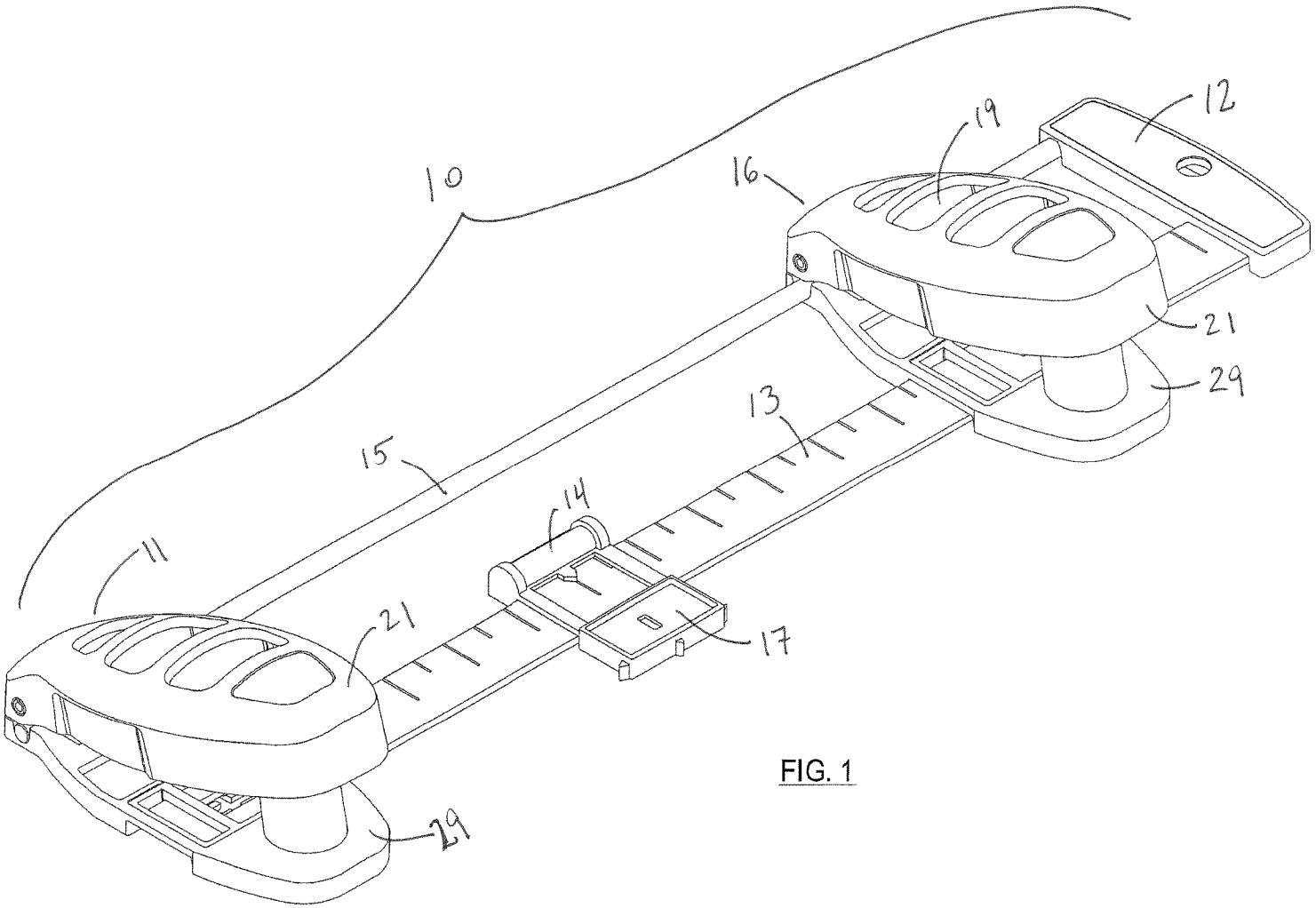
FIG. 1 is a top perspective view of an embodiment of the invention showing the supporting frame with optional ruler, fixed punch assembly, sliding punch assembly, magnetized nail tray, and bubble level assembly.
Figure 2A:
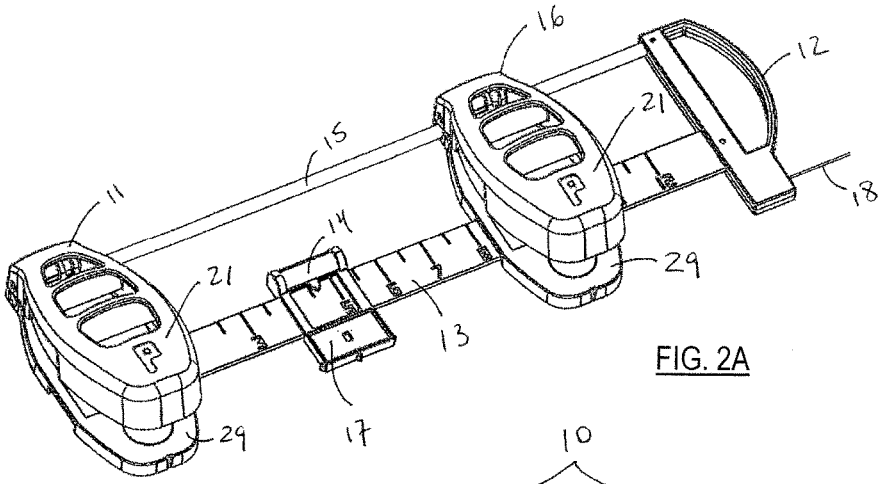
FIG. 2A is another top perspective view of an embodiment of the invention.
Figure 2B:
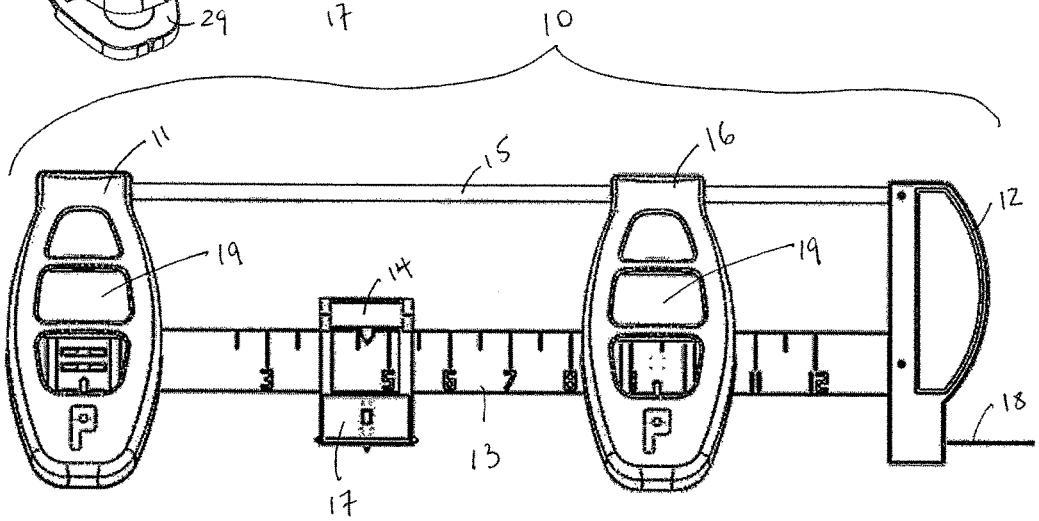
FIG. 2B is a top plan view of the embodiment of FIG. 2A.
Figure 3:
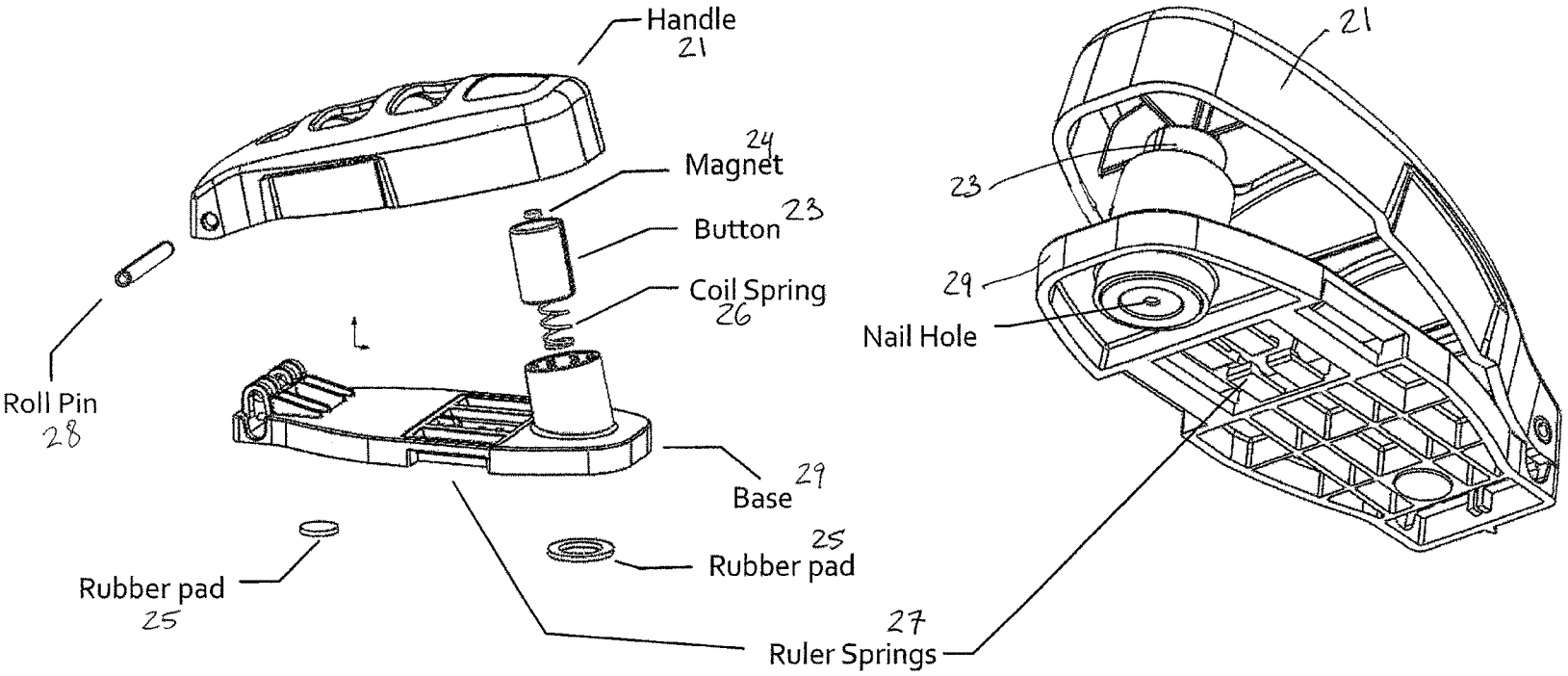
FIG. 3 is an exploded view and a constructed view of an embodiment of a punch assembly of the invention including a handle, base, and elements of an embodiment of a nail holding unit that includes button assembly, magnet, anvil, and coil spring.
Figure 4:
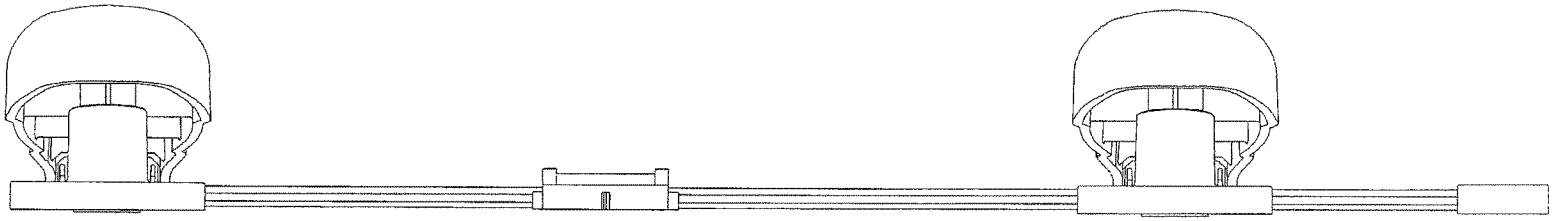
FIG. 4 is a side view of an embodiment of the present invention.
Figure 5:
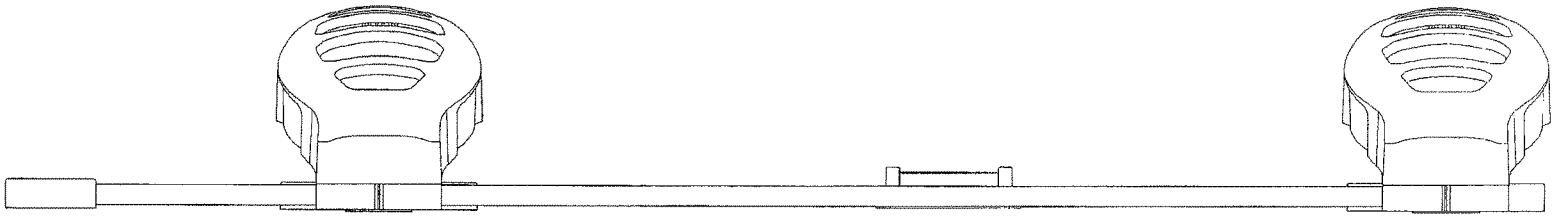
FIG. 5 is an opposite side view of an embodiment of the present invention.
Figure 7:
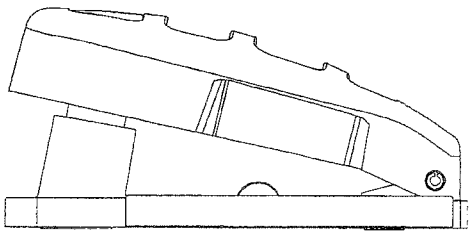
FIG. 7 is an opposite side view of an embodiment of a punch assembly of the present invention.
Figure 6:
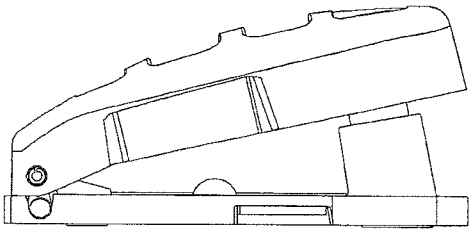
FIG. 6 is a side view of an embodiment of a punch assembly of the present invention.

Referring to the drawings wherein like reference characters designate like or corresponding parts throughout the several views, and referring particularly to FIGS. 1-3, it is seen that the illustrated embodiment includes a frame 10 having a first punch assembly 11 fixed at one end thereof, an end frame section that includes a handle 12 at the opposite end thereof, a connecting member 13 provided between the fixed punch assembly 11 and the end handle 12, and a second connecting member 15 provided in parallel with connecting member 13 between punch assembly 11 and end handle 12. In the illustrated embodiment, connecting member 13 is flat and connecting member 15 is a cylindrical rod, but other configurations may also be used for these connecting members. A second slidable punch assembly 16 is provided on frame 10 that is movable along member 13 and rod 15 between the fixed punch assembly 11 and end handle 12. In the illustrated embodiment, the connecting member 13 is in the form of a ruler that allows measurement alignment, and which supports a sliding bubble level assembly 14.

The fixed punch assembly 11 and the sliding punch assembly 16 provide for a sturdy frame and variable-position insertion of nails or studs, using their handles 21 for impact on the nails 20 to be inserted. The illustrated sliding bubble level assembly 14 is provided for proper leveling. An optional magnetic nail tray 17 may be provided on assembly 14 located on the flat portion of the frame 13. An optional laser 18 may be provided for more precise leveling and, when needed, alignment with other references located at a distance on a wall. Apertures 19 may be provided in the handles 21 of the punch assemblies 11 and/or 16 in order to allow for viewing (which may include magnification) through the punch assemblies for more accurate placement of nails. These components may be integrated to provide the user all of the necessary elements for effective nail insertion in one complete package.

FIG. 3 shows views of an exemplary punch assembly including a handle 21 pivotally mounted to a base 29, and a mechanism for holding nails in place prior to insertion. A key component is the mechanism that holds a nail in place prior to insertion into a wall. In the exemplary embodiment of FIG. 3, the illustrated mechanism includes a button assembly 23 having a bore 22 therein for tightly holding a nail 20, a magnet 24 for holding a metallic nail 20 inside the button assembly 23, an optional anvil to absorb impact, and a coil spring 26 that urges the assembly to an open position for loading a nail and placement on a wall. All of these components work together to provide for a solidly held nail prior to insertion. The base 29 of the sliding punch assembly 16 may include one or more spring mechanisms 27 that act against flat member 13 to hold the base 29 on member 13 at a desired location. A round roll pin 28 may be inserted into the punch assembly base 29 to allow the handle portion 21 to pivot about the punch assembly when the handle is impacted. Rubber pads 25 may also be provided underneath base 29 to prevent base 29 from damaging or scraping against the wall.

Figure 8:
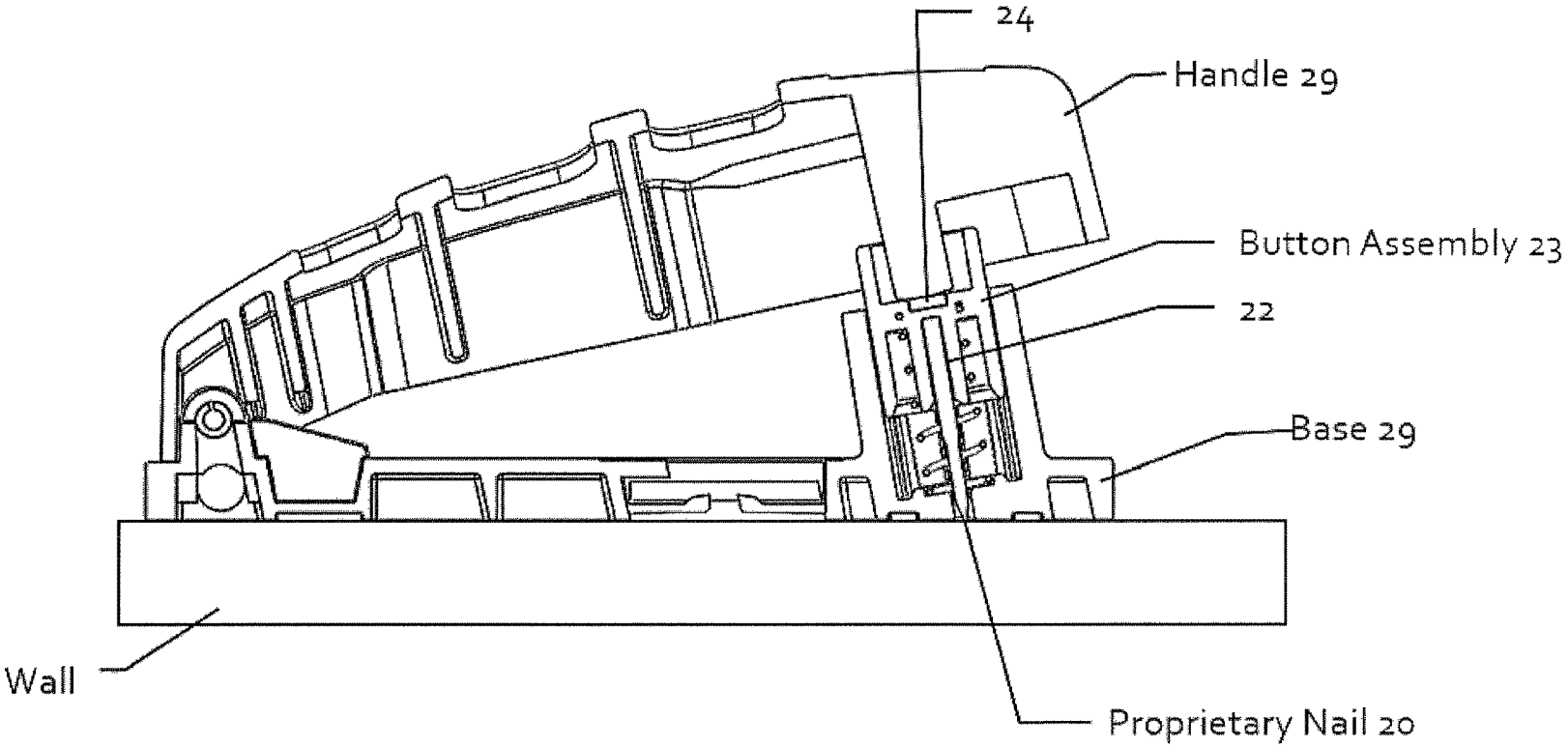
FIG. 8 is a cross-sectional side view of a punch assembly of the present invention containing a nail in position for nail insertion and the placement of the nail to be inserted.
Figure 9:
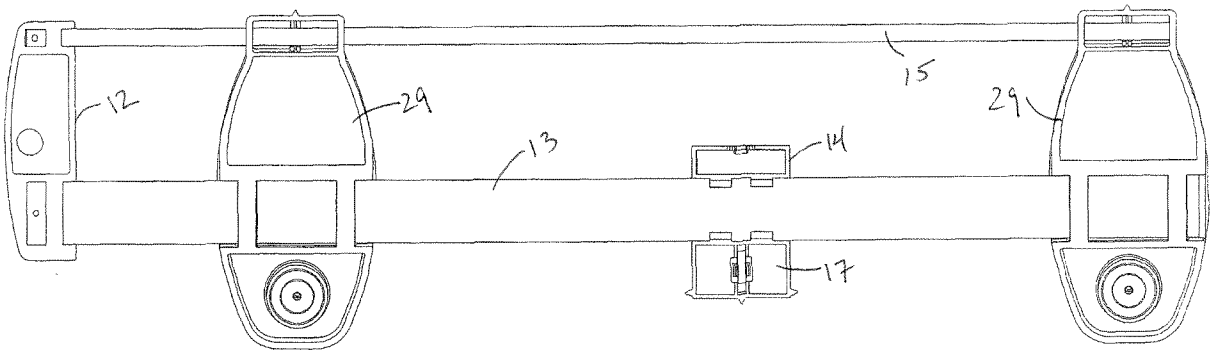
FIG. 9 is a bottom view of an embodiment of the present invention.
Figure 10:
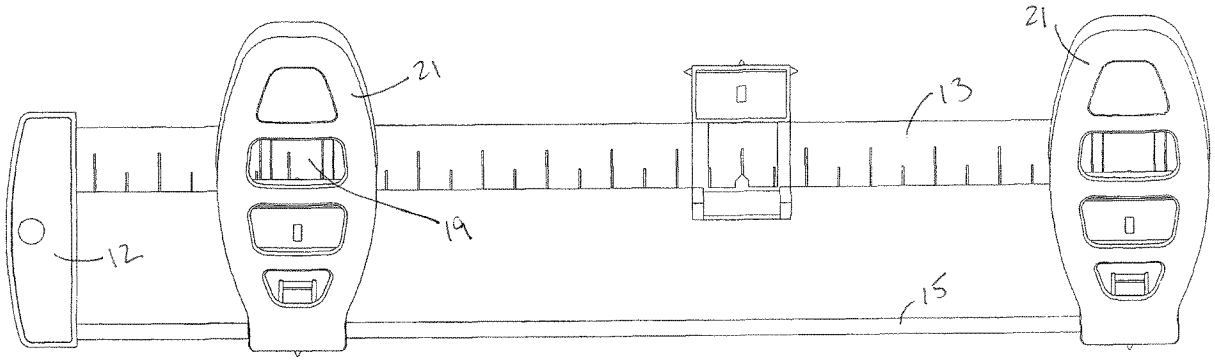
FIG. 10 is a top view of an embodiment of the present invention.

FIG. 8 shows a cross-section of an embodiment of a punch assembly, showing the elements in place in a ready-to-go position prior to inserting a nail 20. Applying force to the handle 21 of the punch assembly provides the necessary impact to insert the nail. The button assembly 23, with magnet 24, bore 22, spring 26 and base 29 form a system for holding the nail 20 in place prior to its insertion into a wall. The spring holds back the handle and the magnet holds the nail in place until impact. After impact, the spring pushes the handle back to its pre-impact position.

In alternative embodiments, an extension (not shown) may be provided on each of handles 21 of the punch assemblies 11 and 16. These extensions provide a larger surface against which a user may exert force to drive a nail 20 into a wall. In some embodiments, these extensions may connect together so that the user may insert both nails by imparting a single force to both extensions.

In alternative embodiments, frame handle 12 may extend out from (i.e., perpendicular to) the wall or other surface to facilitate easy movement, adjustment and positioning of the device.

It is to be appreciated that in order to provide for clean, accurate and predictable placement and insertion of nails, the nails must be snugly secured to avoid any wobbling or side movement during the insertion process. Accordingly, embodiments of the invention include a narrow channel inside button assembly 32 for holding the nails. It is therefore to be appreciated that the nails used in most embodiments of the invention will have shafts and pointed ends, but will not have heads, since this would require a wider channel and would open the possibility of mis-directed nail insertions. In other embodiments, the nails may have heads, but are preferably elongated headless shafts (e.g., finishing nails) that fit snugly in the sleeves to provide more precise insertion.

Operation of a Preferred Embodiment

In order to use the illustrated embodiment of the invention, nails 20 are loaded into both punch assemblies 11 and 16, and slidable punch assembly 16 is positioned along stabilizing bar 13 (using the measurements of the ruler) so that the two punch assemblies are spaced apart at a selected distance. The frame 10 is then placed against the wall, and moved until it is level according to the bubble level 14 on the ruler, and/or according to the optional laser 18. The user then inserts nails by applying punching force to the handles 21 of each punch assembly, thereby driving a nail from each assembly into the wall. The frame is removed from the wall, and each assembly is then re-loaded with another nail for the next use.

It is to be appreciated that different versions of the invention may be made from different combinations of the various features described above. It is to be understood that other variations and modifications of the present invention may be made without departing from the scope thereof. It is also to be understood that the present invention is not to be limited by the specific embodiments disclosed herein, but only in accordance with the claims when read in light of the foregoing specification.

What is claimed is:

1. A leveling and nail insertion device comprising at least two punch assemblies provided on a pair of parallel stabilizing bars wherein a first punch assembly is fixedly attached at one end of the stabilizing bars and a hand grip is provided at the opposite ends of the stabilizing bars forming a frame, and wherein a second punch assembly is movably provided on said stabilizing bars; each punch assembly further comprising a handle that is pivotally attached at one end to a base, the base being engaged with said stabilizing bars, each punch assembly further comprising a nail insertion mechanism comprising a sleeve for receiving a nail, a magnet for holding the nail in place, and a coil spring for maintaining the handle in striking position such that applying force to the handle collapses the spring and causes a nail to be forcibly driven out.

2. The device of claim 1 wherein one of said stabilizing bars is in the form of a flat member having measuring indicia thereon.

3. The device of claim 2 wherein a slidable level is provided on said flat member.

4. The device of claim 3 wherein a magnetic nail holder is provided on said level.

5. The device of claim 1 wherein openings are provided in each punch assembly handle to allow the user to view the placement of the nail before it is inserted.

6. The device of claim 5 wherein said openings include at least one magnifying lens to assist in viewing.

7. The device of claim 1 wherein the nails used in said punch assemblies are finishing nails having no heads.

8. The device of claim 1 further comprising at least one laser device attached thereto for leveling said device prior to insertion of nails into a wall.

9. The device of claim 1 further comprising at least one laser device attached at one end of said frame to align the device with existing nails prior to insertion of additional nails.

10. The device of claim 1 further comprising a third punch assembly mounted on said parallel stabilizing bars between first and second punch assemblies.

11. The device of claim 1 further comprising an extension mounted on at least one of the handles of said punch assemblies.

12. A method of hanging an object on a wall or surface requiring two mounting points comprising the steps of:

(a) loading nails into sleeves of a device comprising at least two punch assemblies provided on a pair of parallel stabilizing bars wherein a first punch assembly is fixedly attached at one end of the stabilizing bars and a handle is provided at the opposite ends of the stabilizing bars forming a frame, and wherein a second punch assembly is movably provided on said stabilizing bars; each punch assembly further comprising a handle that is pivotally attached at one end to a base, the base being engaged with said stabilizing bars, each punch assembly further comprising a nail insertion mechanism comprising a sleeve for receiving a nail, a magnet for holding the nail in place, and a coil spring for maintaining the handle in striking position;

(b) moving the second punch assembly to a desired location along said stabilizing bars relative to the first punch assembly;

(c) positioning the device at a desired location on a wall or surface; and (d) inserting nails into the wall or surface by striking the handles of each of said punch assemblies.

13. The method of claim 12 wherein said device further comprises measuring indicia on one of said stabilizing bars, and comprising the further step of using the measuring indicia to position said second punch assembly before inserting nails.

14. The method of claim 13 wherein each punch assembly handle further comprises at least one opening having a magnifying lens therein, and comprising the further step of using said magnifying lens to position said second punch assembly before inserting nails.

15. The method of claim 12 wherein said device further comprises a level located on one of said stabilizing bars, and comprising the further step of using the level to position the device on a surface before inserting nails.

16. The method of claim 15 wherein said device further comprises at least one laser located on said device, and comprising the further step of using the at least one laser to position the device on the wall or surface before inserting nails.

* * * * *